United States Patent [19]

Kratz et al.

[11] Patent Number: 4,704,965

[45] Date of Patent: Nov. 10, 1987

[54] BLIND-SETTING DEVICE FOR A DETONATOR

[75] Inventors: Bernhard Kratz, Wendelstein; Gunter Postler, Rothenbach, both of Fed. Rep. of Germany

[73] Assignee: Diehl GmbH & Co., Nurnberg, Fed. Rep. of Germany

[21] Appl. No.: 929,068

[22] Filed: Nov. 7, 1986

[30] Foreign Application Priority Data

Nov. 29, 1985 [DE] Fed. Rep. of Germany ..... 3542209

[51] Int. Cl.[4] ..... F42C 9/06; F42C 15/04; F42C 15/28

[52] U.S. Cl. ..... 102/226; 102/228; 102/229; 102/256; 102/259

[58] Field of Search ..... 102/262, 258, 259, 254, 102/255–260, 221, 222, 226–230

[56] References Cited

U.S. PATENT DOCUMENTS

| | | | |
|---|---|---|---|
| 3,961,555 | 6/1976 | Zellmer et al. | 102/262 X |
| 4,019,441 | 4/1977 | Morgen et al. | 102/262 |
| 4,202,271 | 5/1980 | Day | 102/262 X |
| 4,407,201 | 10/1983 | Jensen | 102/255 X |
| 4,449,454 | 5/1984 | Liebhardt et al. | 102/259 X |
| 4,534,292 | 8/1985 | Weber et al. | 102/256 X |
| 4,599,945 | 7/1986 | Graustra et al. | 102/256 |

FOREIGN PATENT DOCUMENTS 2023778 1/1980 United Kingdom .

*Primary Examiner*—David H. Brown

*Attorney, Agent, or Firm*—Scully, Scott, Murphy & Presser

[57] ABSTRACT

A blind-setting or protective blocking device for a detonator, in particular for a detonator of a launched bomb, in which a release or tripping lever maintains a securing slider in a secured position. The tripping lever is maintained against the force of a spring through the intermediary of two latching elements, wherein, as a rule, the first latching element is released by an electronic circuit of the detonator within the launch tube or barrel, and the second latching element is released by the circuit subsequent to exiting from the launch tube, as a result of which the securing slider is placed into the armed position. The tripping lever is equipped with a projection which is associated with a contact stop on the securing slider, and in which the projection, in the secured position, is located outside of the path of movement of the contact stop, and pivots into the path of movement of the contact stop when the second latching element is also released prior to exiting from the launch tube.

3 Claims, 3 Drawing Figures

BLIND-SETTING DEVICE FOR A DETONATOR

BACKGROUND OF THE INVENTION

1. Field of the Invention

The present invention relates to a blind-setting or protective blocking device for a detonator, in particular for a detonator of a launched bomb, in which a release or tripping lever maintains a securing slider in a secured position, and wherein the tripping lever is maintained against the force of a spring through the intermediary of two latching elements, wherein, as a rule, the first latching element is released by an electronic circuit of the detonator within the launch tube or barrel, and the second latching element is released by the circuit subsequent to exiting from the launch tube, as a result of which the securing slider is placed into the armed position.

2. Discussion of the Prior Art

The present invention is an improvement over the prior art device shown and disclosed in U.S. Pat. No. 4,449,454 issued May 22, 1984. The entire disclosure of that patent is herein incorporated by reference as typical of prior art devices in which the subject invention provides an improved safety mechanism.

In a detonator of the type under consideration, the latching elements are formed by force or power components, which are triggered by the electronic circuit, as a result of which the power elements release themselves from the tripping lever, and free the lever from the secured position. In the normal case, the first latching element is triggered as long as the bomb is located within the launch tube or weapon barrel of the weapon carrier. The second latching element is triggered when the bomb has exited from the launched tube for a certain distance (safety of the barrel muzzle section). The securing slider will then move into the armed position.

Upon the occurrence of a malfunction of the electronic circuit it may not be ruled out of question that the second latching element is also triggered while the bomb is still located within the launch tube. The securing slider will then immediately move into the armed position upon exiting from the tube. This can lead to an endangering of the weapon carrier.

SUMMARY OF THE INVENTION

Accordingly, it is an object of the present invention to provide a protective blocking or blind-setting device of the above-mentioned type which will prevent the securing slider from being moved into the armed position when both latching elements are released within the launch tube or weapon barrel.

Inventively, the foregoing object is achieved through the intermediary of a blind-setting device of the above-mentioned type, in that the tripping lever is equipped with a projection which is associated with a contact stop on the securing slider, and in which the projection, in the secured position, is located outside of the path of movement of the contact stop, and pivots into the path of movement of the contact stop when the second latching element is also released prior to exiting from the launch tube.

When the second latching element is also triggered within the launch tube, the projection on the tripping lever will pivot so as to extend into the path of movement of the slider. Subsequent to exiting from the launch tube, the projection blocks the slider at the contact stop. Consequently, the slider is prevented from moving into the armed position. Thereby, the detonator is blind-set or blocked.

Herein, the tripping lever assumes a dual function. On the one hand, the tripping lever maintains the slider in the secured position and, on the other hand, as necessary, it blocks the slider along its path of movement into the armed position.

The construction of the blind-setting device is simple. For effecting the blocking or blind-setting upon any malfunctioning of the electronic circuit there is no need for an additional separate structural component.

BRIEF DESCRIPTION OF THE DRAWINGS

Reference may now be had to the following detailed description of an exemplary embodiment of the invention, taken in conjunction with the accompanying drawings; in which.

DETAILED DESCRIPTION

Figure 3:
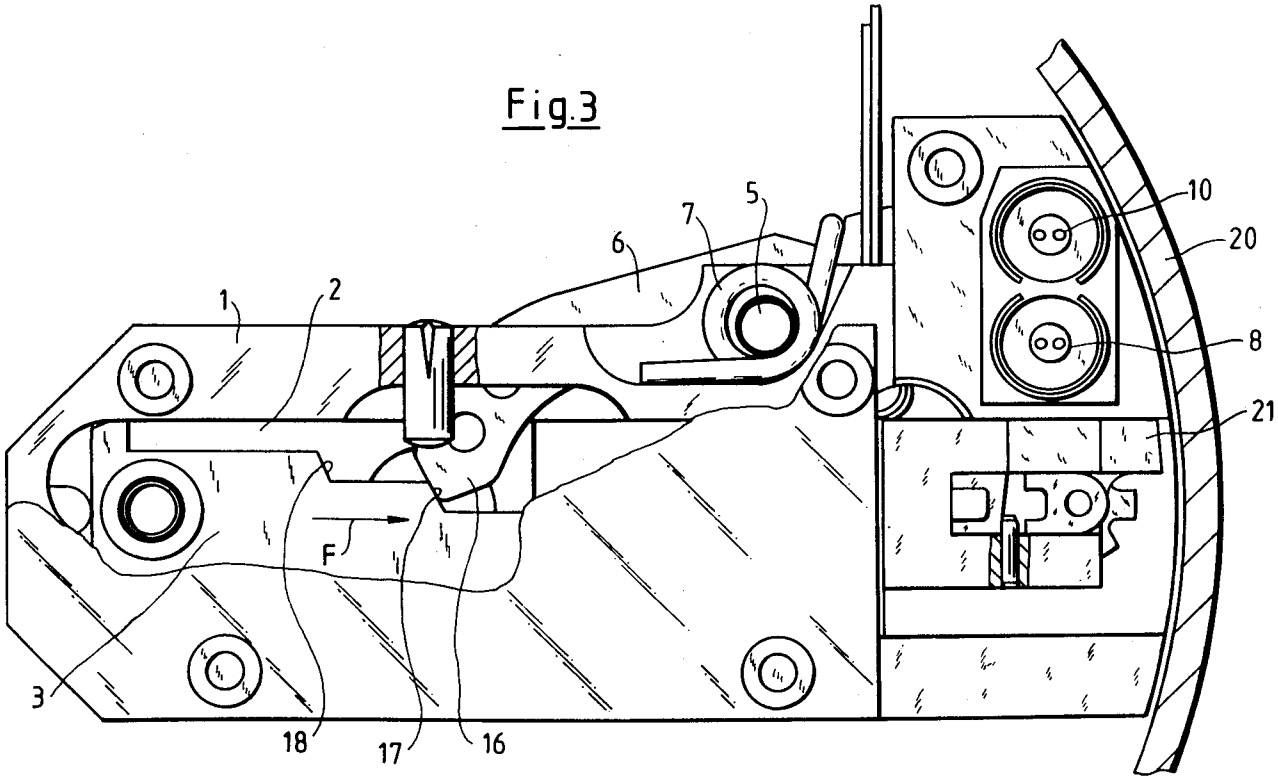
FIG. 3 illustrates the blind-setting device located in the launch tube as viewed in the direction of arrow III in FIG. 2.

The blind-setting device for a detonator 30 possesses a base member 1. Supported within a guide 2 in the base member is a securing slider 3 so as to be displaceable in the direction of arrow F by the force of a pressure spring 4. A detonating element 31 is carried on slider 3. An opening or bore 32 extends through the base 1. When the detonating element 31 is aligned with the bore 32, the slide 3 is deemed to be in its armed condition and an explosive firing chain is established. This is the same type of firing chain that is shown and disclosed in U.S. Pat. No. 4,449,454 Column 4, lines 3–32. A tripping lever 6 is pivotably supported on a pivot pin 5 of the base member 1. The tripping lever 6 is tensioned by a helical coil spring 7 (as shown in FIG. 3).

Figure 2:
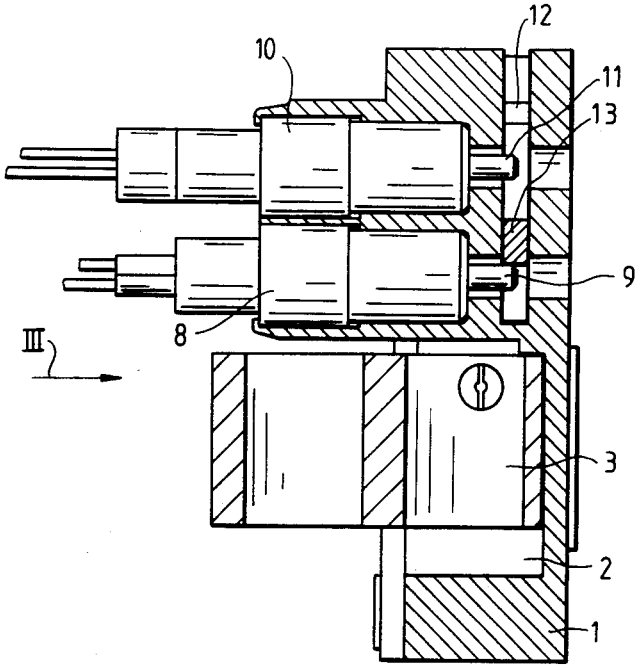
FIG. 2 illustrates a sectional view taken along line II—II in FIG. 1.

Arranged on the base member 1 is a first latching element 8 possessing a locking pin 9, and a second latching element 10 possessing a locking pin 11 (as shown in FIG. 2). Both latching elements 8, 10 are adapted to be triggered by an electronic circuit (not shown) so that the locking pins 9, 11 will displace themselves from the position illustrated in FIG. 2.

The tripping lever 6 possesses a projection 12 which is associated with the locking pin 11. Provided on the tripping lever 6 is a lateral edge 13. Contiguous to the lateral edge 13 is a projection 14 on the tripping lever 6. This projection 14 abuts contact stop 15 on the securing slider 3 associated therewith.

Figure 1:
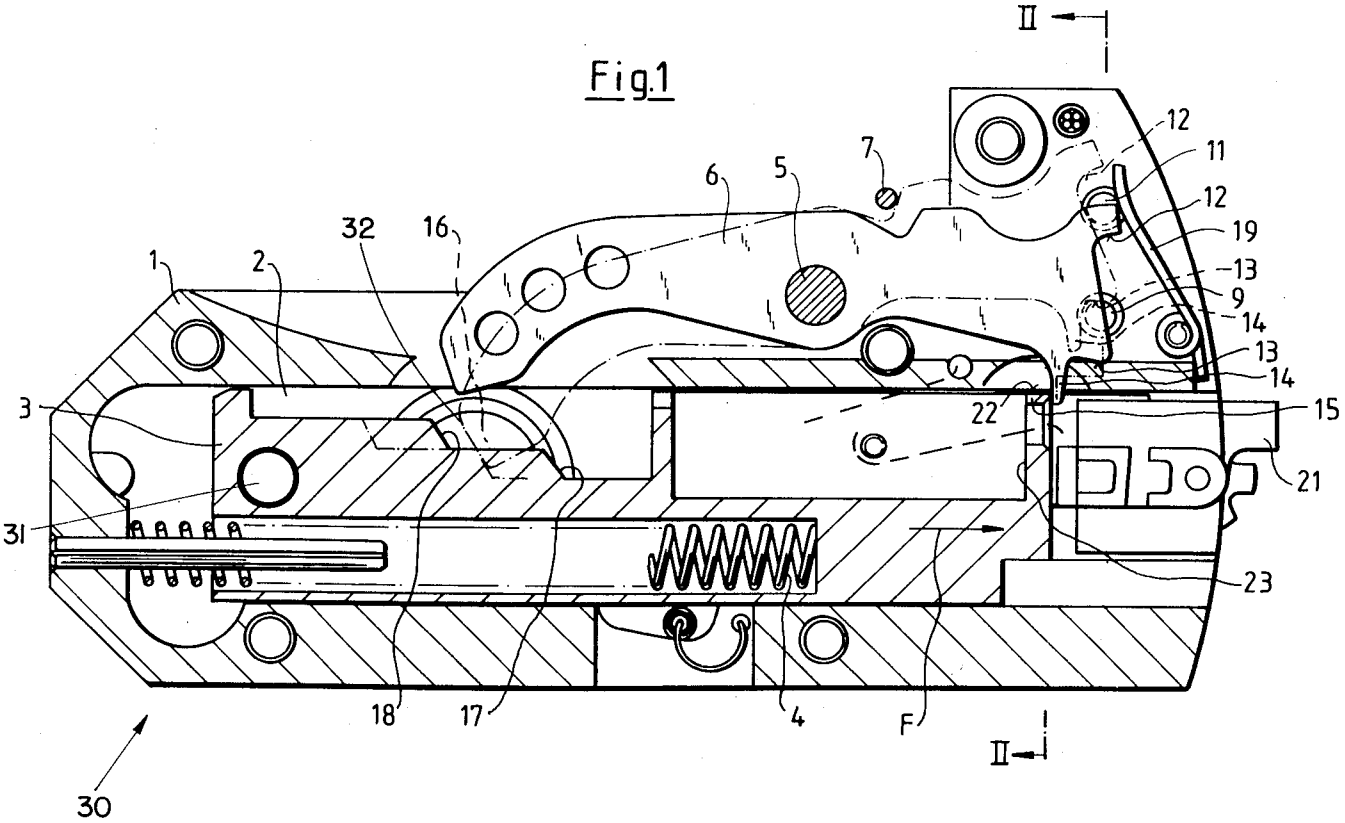
FIG. 1 illustrates a blind-setting device for a detonator.

In FIG. 1, the secured position of the tripping lever 6 is illustrated by means of phantom-lines.

In FIGS. 2 and 3 there is illustrated the secured position of the tripping lever 6. In the secured position of the tripping lever 6, the lateral edge 13 contacts against the locking pin 9. The tripping lever 6 is then located with its free end 16 in front of a step 17 formed in the securing slider 3. Hereby, the projection 19 is located outside of the path of movement of the contact stop 15.

When the latching element 8 is triggered, then the locking pin 9 disappears or retracts, so that the projection 12 comes into contact with the locking pin 11 in response to the biasing action of the helical coil spring 7. The projection 14, however, is presently still outside of the path of movement of the contact stop 15. The free end 16 of the tripping lever 6 stands opposite a further step 18 formed in the securing slider 3. The end of the lever is raised over the step 17. A leaf spring 19 bears against the locking pin 11.

As long as the detonator remains within the launch tube or weapon barrel 20 (as shown in FIG. 3), the free end 16 of the tripping lever will not strike against the step 18. This is because the securing slider 3 is held back at its head end 21 by the launch tube 20.

When the detonator has exited from the launch tube 20, the securing slider 3 will then displace to such an extent under the force of the pressure spring 4, until the step 18 therein strikes against the free end 16 of the tripping lever 6. However, the armed position has not yet been reached. This is because the projection 12 is still positioned on the locking pin 11. The sliding surface 22 of the securing slider 3 which adjoins the contact stop 15 has now slid itself below the projection 14.

When the latching element 10 is now also triggered, then the locking pin 11 will also disappear or retract so that the tripping lever 6 is raised above the step 18 in response to the biasing action of the helical coil spring 7. Thereby, the securing slider 3 is moved into its armed position under the effect of the pressure spring 4. The projection 14 then dips into the recess 23. The heretofore described mode of operation is the usual or normal mode of operation.

When, upon a malfunctioning of the electronic circuit, there is initially triggered the latching element 10, there then disappears or retracts the locking pin 11 against which there bears the lever spring 19. The lever spring 19 then snaps below the projection 12. At a subsequent triggering of the latching element 8, the tripping lever 6 can no longer release the securing slider 3. This is because the lever spring 19 blocks the tripping lever 6. As a result, for this instance of malfunctioning, due to the lever spring 19 there is achieved a blocking or blind-setting of the detonator.

Upon another malfunctioning of the ignition circuit, there is triggered, correctly, the latching element 8 ahead of the latching element 10. When the triggering of the latching element 10 has than been effected prior to the detonator exiting from the launch tube 20, then the sliding surface 22 of the securing slider 3 has not yet slid below the projection 14, since this was not yet possible because the head end 21 is held back by the launch tube 20. The projection 14 now pivots into the path of movement of the contact stop 15. The latter, subsequent to exiting from the launch tube 20, strikes against the projection 14. The securing slider is thereby blocked in such a manner, as to be unable to move into its armed position. This further blind-setting or blocking of the detonator is illustrated in FIG. 1 by the continuous line.

What is claimed is:

1. A blind-setting or protective blocking device for a detonator, especially the detonator of a launched bomb exiting from a launch tube, said device having a securing slider movable between one or more secured positions and an armed position, means for biasing the securing slider toward the armed position, releaseable means disposed in the path of the slider for preventing the slider from moving to its armed position so long as the device is within a launch tube and for allowing the slider to move to its armed position upon exit from the launch tube, and an elongated tripping lever, said lever having first and second ends said first end for engaging and maintaining said slider in one of said secured positions, said tripping lever being pivotably supported at a position along its length intermediate said two ends and biased to pivot in a direction for disengaging said first end from said slider, first and second latching elements each for engaging the second end of said tripping lever and maintaining said tripping lever in a position for keeping said first end engaged with the slider and maintaining said slider in a secured position, said latching elements operable to normally sequentially disengage from said second trigger lever end, said first latching element for normally disengaging while the device is within the launch tube and said second latching element for normally disengaging after the device exits the launch tube so that the slider will then move to its armed position, an improvement to prevent the movement of the slider to its armed position in the event the second latching element operates prior to the exit of the device from the tube, said improvement comprising a projection disposed on said tripping lever and normally out of the path of said securing slider but extending from said tripping lever and moveable therewith in a direction to intersect and block the path of said securing slider when said second latching element operates prior to the exit of the device from the tube and releases the tripping lever while said device is inside said tube, and contact stop means carried by said securing slider for engaging the projection means in the path of the slider and thereby arresting the movement of the slider before it travels to the armed position.

2. A blind-setting device as claimed in claim 1, wherein the projection is pivoted into a position along the path of movement of securing slider to engage the contact stop and thereby arrest motion of the securing slider before the slider reaches its armed position upon exiting the launch tube.

3. A blind-setting device as claimed in claim 1, further comprising a recess in said securing slider adjacent said contact stop, said recess for receiving said projection during the normal operation of said latching elements.

* * * * *